US005732416A

United States Patent [19]

Albert

[11] Patent Number: 5,732,416

[45] Date of Patent: Mar. 31, 1998

[54] COMMODE BOWL SPLASH GUARD

[76] Inventor: Raul Albert, 6004 West Fern Street, Tampa, Fla. 33634-5137

[21] Appl. No.: 783,261

[22] Filed: Jan. 15, 1997

[51] Int. Cl.[6] ..... E03D 9/00

[52] U.S. Cl. ..... 4/300.3; 4/DIG. 5

[58] Field of Search ..... 4/300.3, DIG. 5, 4/661

[56] References Cited

U.S. PATENT DOCUMENTS

| | | | |
|---|---|---|---|
| 1,682,798 | 9/1928 | Richards | 4/DIG. 5 X |
| 1,857,328 | 5/1932 | Piper | 4/DIG. 5 X |
| 2,141,341 | 12/1938 | Bentz | 4/DIG. 5 X |
| 2,709,816 | 6/1955 | Lamb | 4/DIG. 5 X |
| 2,839,764 | 6/1958 | Gardner | 4/237 |
| 4,215,443 | 8/1980 | Babif | 4/300.3 |
| 4,912,784 | 4/1990 | Jacobson et al | 4/300.3 |
| 5,373,589 | 12/1994 | Rego et al. | 4/300.3 |

FOREIGN PATENT DOCUMENTS

| | | | |
|---|---|---|---|
| 0261137 | 10/1990 | Japan | 4/300.3 |

*Primary Examiner*—Charles E. Phillips
*Attorney, Agent, or Firm*—Joseph N. Breaux

[57] ABSTRACT

A sanitary device for use in restrooms including a flexible splash guard member constructed from a waterproof plastic material; seat securing structures for allowing a top splash guard section of the splash guard member to be secured to the toilet seat; and a spring connector mechanism including at least one coiled spring for securing a bottom splash guard section of the splash guard member to the rim of a commode bowl in a manner such that the bottom section is biased into the commode bowl by the coiled spring. The bottom splash guard section preferably includes left and right rim top flaps that each cover sections of the top area of a commode bowl rim and a centrally depending rim cover, positioned between the left and right rim top flaps, that depends down into the commode bowl when the commode bowl splash guard is installed. The top splash guard section of the splash guard member is preferably provided with one or more perforated holding pockets for holding and dispensing solid air fresheners and disinfectant blocks. The perforated holding pockets are preferably provided on a back surface of the top splash guard section.

12 Claims, 2 Drawing Sheets

COMMODE BOWL SPLASH GUARD

TECHNICAL FIELD

The present invention relates to sanitary devices for use in restrooms and more particularly to a commode bowl splash guard securable between the toilet seat and rim of a commode bowl that includes a flexible splash guard member, a seat securing mechanism for securing a top splash guard section of the splash guard member to the toilet seat and a spring connector mechanism including at least one coiled spring for securing a bottom splash guard section of the splash guard member to the rim of a commode bowl in a manner such that the bottom section is biased toward the commode bowl by the coiled spring. The top section of the splash guard member is preferably provided with one or more perforated holding pockets for holding and dispensing solid air fresheners and disinfectant blocks.

BACKGROUND OF THE INVENTION

The area surrounding the commode bowl in a restroom can become unsanitary because of splashing and misdirected urine streams while using the toilet. These splashes and misdirected urine streams are most prevalent around the back area of the commode bowl in the area where the toilet seat and cover are pivotally secured to the commode bowl. In addition, because this area of the commode bowl rim is covered by the seat and lid pivoting structures, it is difficult to properly clean and sanitize this area. It would, therefore, be a benefit to have a splash guard for the commode bowl positioned across the area between the commode bowl rim and the underside of the toilet seat that would extend over and cover the rear area of the commode bowl rim and toilet seat pivoting mechanism to prevent the splashed commode water and misdirected urine streams from contacting and accumulating in this area.

SUMMARY OF THE INVENTION

It is thus an object of the invention to provide a commode bowl splash guard that is connectable between the underside of the toilet seat and the commode bowl rim in a manner to cover and protect these elements from splashing and misdirected urine streams when the toilet seat is in the raised position.

It is a further object of the invention to provide a commode bowl splash guard that is securable between the toilet seat and rim of a commode bowl that includes a flexible splash guard member, a seat securing mechanism for securing a top section of the splash guard member to the toilet seat, and a spring connector mechanism including at least one coiled spring for securing a bottom section of the splash guard member to the rim of a commode bowl in a manner such that the bottom section is biased toward the commode bowl by the coiled spring.

It is a still further object of the invention to provide a commode bowl splash guard that includes dual seat securing mechanisms that each allow the top splash guard section of a splash guard member to be secured to the toilet seat.

It is a still further object of the invention to provide a commode bowl splash guard having one or more perforated holding pockets for holding and dispensing solid air fresheners and disinfectant blocks.

It is a still further object of the invention to provide a commode bowl splash guard that accomplishes all or some of the above objects in combination.

Accordingly, a commode bowl splash guard that is securable between the toilet seat of a toilet and the rim of a commode bowl is provided. The commode bowl splash guard includes a flexible splash guard member constructed from a waterproof plastic material; seat securing structures for allowing a top splash guard section of the splash guard member to be secured to the toilet seat; and a spring connector mechanism including at least one coiled spring for securing a bottom splash guard section of the splash guard member to the rim of a commode bowl in a manner such that the bottom section is biased toward the commode bowl by the coiled spring. The bottom splash guard section preferably includes left and right rim top flaps that each cover sections of the top area of a commode bowl rim and a centrally depending rim cover, positioned between the left and right rim top flaps, that depends down into the commode bowl when the commode bowl splash guard is installed. The top splash guard section of the splash guard member is preferably provided with one or more perforated holding pockets for holding and dispensing solid air fresheners and disinfectant blocks. The perforated holding pockets are preferably provided on a back surface of the top splash guard section.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
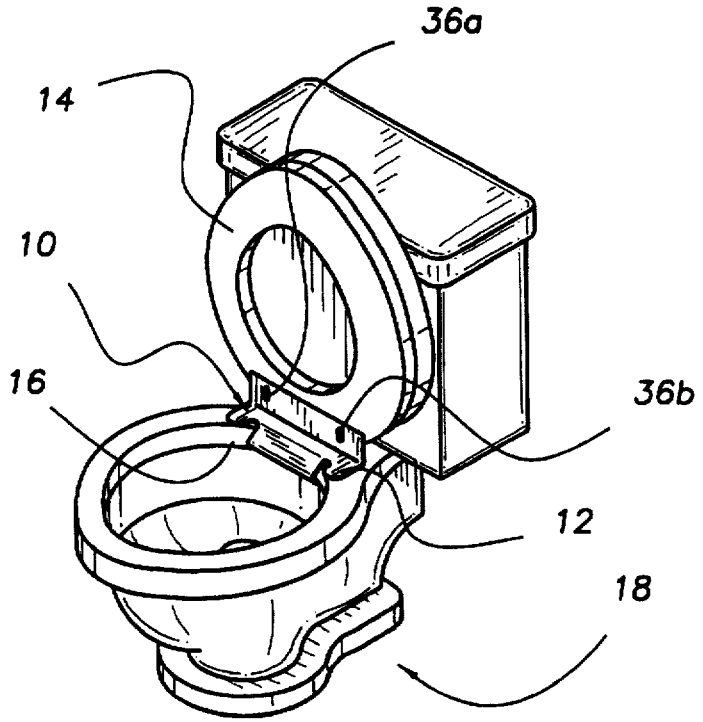
FIG. 1 is a perspective view of an exemplary embodiment of the commode bowl splash guard of the present invention showing the flexible splash guard member secured between the pivotal toilet seat and commode bowl rim of a representative toilet assembly.
Figure 2:
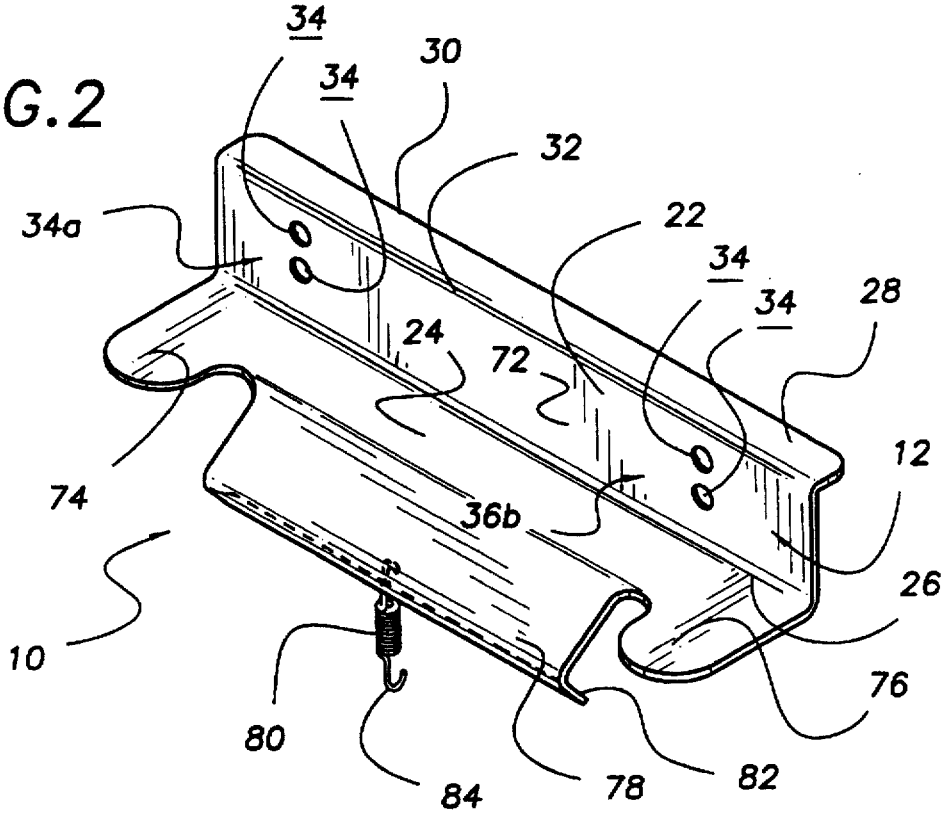
FIG. 2 is a perspective view of the front side of the exemplary commode bowl splash guard of FIG. 1 showing the flexible splash member having the top splash guard section of the splash guard member including the two pairs of top section connecting apertures; and the bottom splash guard section of the splash guard member including the left and right rim top flaps, the centrally depending rim cover, and the helically coiled spring for securing the bottom splash guard section to the rim of a commode bowl in a manner such that the bottom splash guard section is biased into the commode bowl by the coiled spring.

FIG. 1 shows an exemplary embodiment of the commode bowl splash guard of the present invention, generally designated by the numeral 10, including a flexible splash guard member 12 secured between the pivotal toilet seat 14 and commode bowl rim 16 of a representative toilet assembly, generally designated 18. With reference to FIG. 2, flexible splash guard member 12 is formed from a sheet of flexible, waterproof plastic sheeting that has been cut to form a top splash guard section 22 and a bottom splash guard section 24 that are defined by a pivoting crease 26 formed across splash guard member 12. In use, pivoting crease 26 provides a bend line along which splash guard member 12 bends when toilet seat 14 is lifted and lowered.

Top splash guard section 12 has a top edge flap 28 defined between a top perimeter edge 30 of top splash guard section 22 and a top edge bend line 32. Two pairs **34*a*,34*b* of top section connecting apertures 34 are provided through top splash guard section 22. Top section apertures 34 of top section aperture pair 34*a* are spaced apart a sufficient distance to correspond to the mounting screws apertures of the toilet seat hinge 36*a* (FIG. 1). Top section apertures 34 of top section aperture pair 34*b* are spaced apart a sufficient distance to correspond to the mounting screws apertures of the toilet seat hinge 36*b* (FIG. 1). Top section aperture pairs 34*b* and 34*b* are spaced apart a sufficient distance to allow each top section aperture pair 34*a*,34*b* to be aligned with the mounting screws apertures of its respective toilet seat hinge 36*a*,36*b* (FIG. 1). Positioning top section aperture pairs 34*a*,34*b* in this manner allows top splash guard section 22 to be secured to the underside of toilet seat lid 14 with the toilet seat hinge mounting screws used to secure the toilet seat hinges 36*a*,36*b* to toilet seat 14**.

Figure 3:
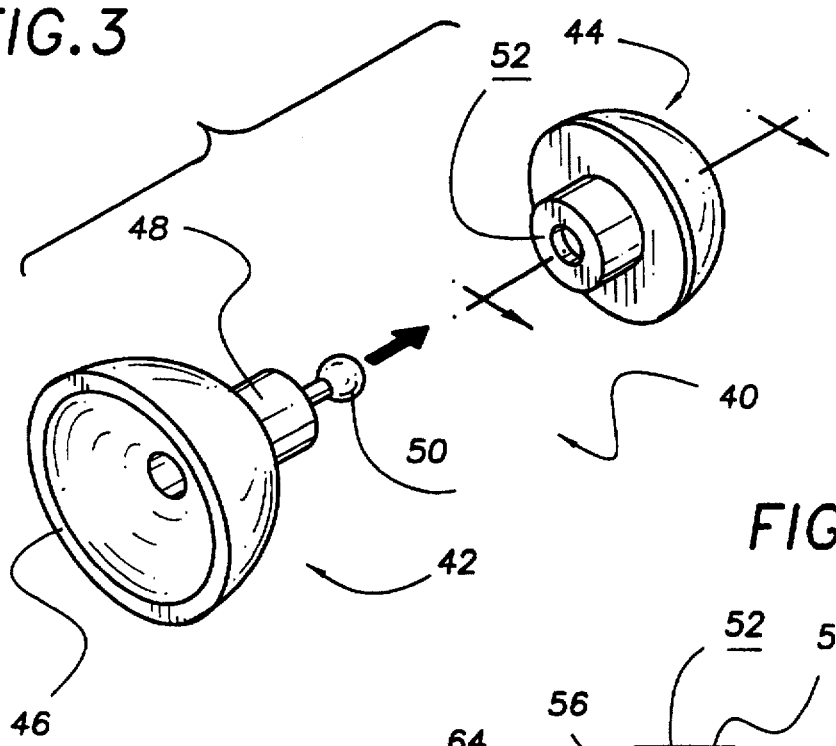
FIG. 3 is a perspective view of one of the four top section connecting suction cup fasteners showing the suction cup member and the cap member.

With reference to FIG. 3, as an alternate mechanism for securing top splash guard section 22 to toilet seat lid 14 four identical top section connecting suction cup fasteners, generally designated 40, are provided with commode bowl splash guard 10. (Only one shown) Each top section connecting suction cup fastener 40 includes a suction cup member, generally designated 42, and a cap member, generally designated 44. Suction cup member 42 includes a resilient suction cup 46, a cylindrical shaped aperture plug 48, and an attachment tab 50. Aperture plug 48 is sized to snugly pass through any of top section apertures 34. Attachment tab 50 is spherically shaped and sized to snap fit into a tab receiving cavity opening 52 formed within cap member 44.

Figure 3A:
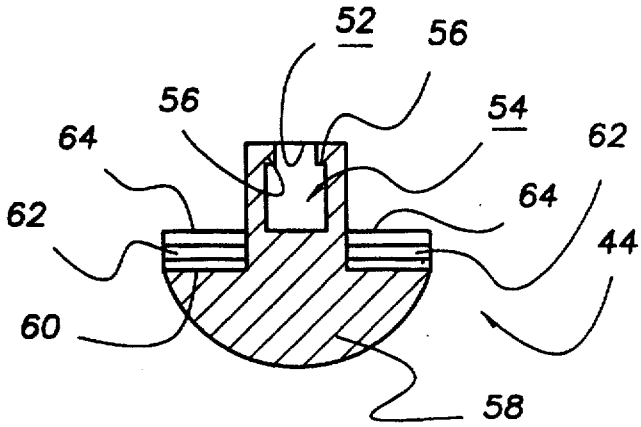
FIG. 3A is a cross-sectional view of the cap member of FIG. 3 along the line I—I showing the cap end, the tab receiving cavity opening, the tab receiving cavity, the sealing adhesive layer, and the peel off sealing layer cover.

With reference to FIG. 3A, tab receiving cavity opening 52 is formed in connection with a tab receiving cavity 54. Tab receiving cavity opening 52 is smaller than tab receiving cavity 54. Once attachment tab 50 is inserted into tab receiving cavity 54, it is held in place by tab locking ledges 56 that define tab receiving cavity opening 52.

Cap member 44 also includes a cap end 58 that is sized sufficiently to prevent passage of cap end 58 through any of top section apertures 34. Cap end 58 forms a contact surface 60 upon which a sealing adhesive layer 62 is deposited. Sealing adhesive layer 62 is covered with a peel off sealing layer cover 64.

In use, each top section connecting suction cup fastener 40 is fastened to top splash guard section 22 by inserting aperture plug 48 through a top section aperture 34 in a manner such that suction cup 46 is positioned on a back surface 70 (FIG. 4) of top splash guard section 22. Peel off sealing layer cover 64 is then removed and cap member 44 is secured to suction cup member 42 by forcing attachment tab 50 into tab receiving cavity 54. Sealing adhesive layer 62 is then forced against a front surface 72 of top splash guard section 22 securing suction cup fastener 40 to top splash guard section 22 and sealing the top section aperture 34.

With reference once again to FIG. 2, bottom splash guard section 24 includes a left rim top flap 74, a right rim top flap 76, and a centrally depending rim cover 78. A stainless steel, helically coiled, spring 80 is secured to a bottom edge 82 of depending rim cover 78. Spring 80 is provided with a rim hook 84 that is attached to the rim of the commode bowl during installation. Spring 80 biases depending rim cover 78 and bottom splash guard section 24 into and toward the commode bowl.

Figure 4:
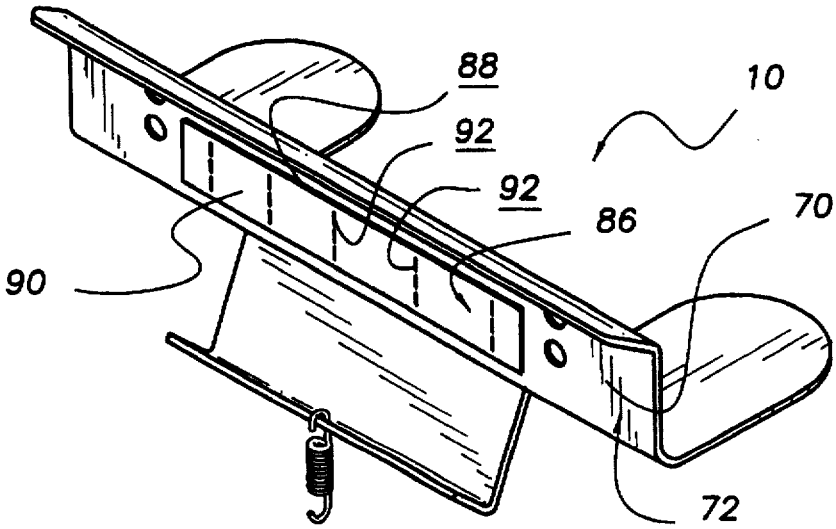
FIG. 4 is a perspective view of the back side of the exemplary commode bowl splash guard of FIG. 1 showing the perforated holding pocket formed onto the back surface of the top splash guard section showing the insertion opening and a number of dispensing perforations.

With reference to FIG. 4, in this embodiment commode bowl splash guard 10 is provided with a perforated holding pocket, generally designated 86, that is formed onto the back surface 70 of top splash guard section 22 by sonic welding a plastic pocket member 90 to back surface 70. Perforated holding pocket has an insertion opening 88 into a holding cavity formed between back surface 70 and pocket member 90. Pocket member 90 is provided with a plurality of perforations 92 therethrough into connection with the holding cavity to provide airflow through the holding cavity. In use blocks of deodorizing and/or disinfecting materials are placed within the holding cavity to provide deodorizing and disinfecting to the commode rim area.

It can be seen from the preceding description that a commode bowl splash guard has been provided that is connectable between the underside of the toilet seat and the toilet rim in a manner to cover and protect these elements from splashing and misdirected urine streams when the toilet seat is in the raised position; that includes a flexible splash guard member, a seat securing mechanism for securing a top section of the splash guard member to the toilet seat, and a spring connector mechanism including at least one coiled spring for securing a bottom section of the splash guard member to the rim of a commode bowl in a manner such that the bottom section is biased into the commode bowl by the coiled spring; that includes dual seat securing mechanisms that each allow the top splash guard section of a splash guard member to be secured to the toilet seat; and that has one or more perforated holding pockets for holding and dispensing solid air fresheners and disinfectant blocks.

It is noted that the embodiment of the commode bowl splash guard described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A splash guard for attachment between a toilet seat and a toilet bowl wherein said seat is pivotally attached to a toilet bowl, so as to prevent fluids from passing between the bowl and seat at the attached area, said guard comprising:

a flexible splash guard member constructed from a waterproof plastic material said splash guard member being divided into a top splash guard section and a bottom splash guard section by a pivoting crease formed across said splash guard member;

seat securing means for allowing said top splash guard section of said splash guard member to be secured to said toilet seat; and a spring connector mechanism including at least one coiled spring connected to said bottom splash guard section of said splash guard member, said coiled spring having a hook securable to a rim of the toilet bowl in a manner that at least a portion of said bottom splash guard section is biased into said toilet bowl by said coiled spring.

2. The commode bowl splash guard of claim 1, wherein:

said bottom splash guard section includes a left rim top flap, a right rim top flap and a centrally depending rim cover, said depending rim cover being positioned between said left and right rim top flaps; and said coiled spring is connected to said depending rim cover.

3. The commode bowl splash guard of claim 2, wherein:

said splash guard member includes a perforated holding pocket, said perforated holding pocket being at least partially defined by a pocket member having a plurality of perforation formed therethrough and into connection with a holding cavity defined between said top splash guard section and said pocket member, said holding cavity being accessible through an insertion opening.

4. The commode bowl splash guard of claim 3 wherein:

said securing means includes four top section connecting apertures formed through said top splash guard section.

5. The commode bowl splash guard of claim 4 further including:

four top section connecting suction cup fasteners, each of said four top section connecting suction cup fasteners including a suction cup member and a cap member, said suction cup member including a resilient suction cup, a cylindrical shaped aperture plug, and an attachment tab, said aperture plug being sized to snugly pass through any of said top section apertures, said cap member including a cap end that is sized sufficiently to prevent passage of said cap end through any of said top section apertures, said cap end forming a contact surface upon which a sealing adhesive layer is deposited, said sealing adhesive layer being covered with a peel off sealing layer cover.

6. The commode bowl splash guard of claim 2 wherein:

said securing means includes four top section connecting apertures formed through said top splash guard section.

7. The commode bowl splash guard of claim 6 further including:

four top section connecting suction cup fasteners, each of said four top section connecting suction cup fasteners including a suction cup member and a cap member, said suction cup member including a resilient suction cup, a cylindrical shaped aperture plug, and an attachment tab, said aperture plug being sized to snugly pass through any of said top section apertures, said cap member including a cap end that is sized sufficiently to prevent passage of said cap end through any of said top section apertures, said cap end forming a contact surface upon which a sealing adhesive layer is deposited, said sealing adhesive layer being covered with a peel off sealing layer cover.

8. The commode bowl splash guard of claim 1, wherein:

said splash guard member includes a perforated holding pocket, said perforated holding pocket being at least partially defined by a pocket member having a plurality of perforation formed therethrough and into connection with a holding cavity defined between said top splash guard section and said pocket member, said holding cavity being accessible through an insertion opening.

9. The commode bowl splash guard of claim 8 wherein:

said securing means includes four top section connecting apertures formed through said top splash guard section.

10. The commode bowl splash guard of claim 9 further including:

four top section connecting suction cup fasteners, each of said four top section connecting suction cup fasteners including a suction cup member and a cap member, said suction cup member including a resilient suction cup, a cylindrical shaped aperture plug, and an attachment tab, said aperture plug being sized to snugly pass through any of said top section apertures, said cap member including a cap end that is sized sufficiently to prevent passage of said cap end through any of said top section apertures, said cap end forming a contact surface upon which a sealing adhesive layer is deposited, said sealing adhesive layer being covered with a peel off sealing layer cover.

11. The commode bowl splash guard of claim 1 wherein:

said securing means includes four top section connecting apertures formed through said top splash guard section.

12. The commode bowl splash guard of claim 11 further including:

four top section connecting suction cup fasteners, each of said four top section connecting suction cup fasteners including a suction cup member and a cap member, said suction cup member including a resilient suction cup, a cylindrical shaped aperture plug, and an attachment tab, said aperture plug being sized to snugly pass through any of said top section apertures, said cap member including a cap end that is sized sufficiently to prevent passage of said cap end through any of said top section apertures, said cap end forming a contact surface upon which a sealing adhesive layer is deposited, said sealing adhesive layer being covered with a peel off sealing layer cover.

* * * * *